US006701944B2

(12) United States Patent
McNabb et al.

(10) Patent No.: US 6,701,944 B2
(45) Date of Patent: Mar. 9, 2004

(54) DETERGENT DISPENSER SYSTEM

(75) Inventors: Richard Paul McNabb, Wirral (GB); Willem Oldenburg, Vlaardingen (NL); Kevin Roberts, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 108 days.

(21) Appl. No.: 10/055,113

(22) Filed: Jan. 23, 2002

(65) Prior Publication Data

US 2002/0117511 A1 Aug. 29, 2002

(30) Foreign Application Priority Data

Jan. 25, 2001 (GB) ..... 0101983

(51) Int. Cl.[7] ..... B08B 3/02

(52) U.S. Cl. ..... 134/93; 134/94.1; 134/201; 137/268

(58) Field of Search ..... 134/57 D, 56 D, 134/58 D, 94.1, 115 R, 93, 201; 222/23, 56, 64, 651, 251, 328, 372, 410; 137/268

(56) References Cited

U.S. PATENT DOCUMENTS

| | | | | |
|---|---|---|---|---|
| 3,178,915 | A | * | 4/1965 | Hertel |
| 3,300,090 | A | * | 1/1967 | Carden |
| 3,398,857 | A | * | 8/1968 | Alio |
| 3,511,409 | A | * | 5/1970 | Huck |
| 3,527,383 | A | * | 9/1970 | Borsum et al. |
| 3,796,347 | A | * | 3/1974 | Hafner |

(List continued on next page.)

FOREIGN PATENT DOCUMENTS

| | | | |
|---|---|---|---|
| CA | 2189115 | | 5/1997 |
| DE | 3135529 | * | 3/1983 |
| DE | 296 15 674 U1 | | 1/1987 |
| DE | 43 44 205 A | | 6/1995 |
| DE | 195 40 958 A1 | | 5/1997 |
| DE | 196 20 888 A1 | | 11/1997 |
| DE | 196 36 497 A1 | | 3/1998 |
| DE | 197 40 819 A1 | | 3/1999 |
| EP | 0461870 A2 | | 12/1991 |
| GB | 1123107 | | 8/1968 |
| GB | 1281517 | * | 7/1972 |
| GB | 1244089 | | 8/1972 |
| GB | 1307387 | | 2/1973 |
| WO | WO 97/01157 | * | 1/1997 |
| WO | 99/24548 | | 5/1999 |

OTHER PUBLICATIONS

European Patent Office 473,532 Mar. 1992.*

Europen Patent Office 576,234 Dec. 1993.*

European Patent Office 628,652 Dec. 1994.*

European Patent Office 699,410 Mar. 1996.*

Search Report under Section 17, Application No. GB 0101983.5 dated Mar. 20, 2002.

International Search Report Application No. PCT/EP 02/00693 mailed Jun. 25, 2002.

*Primary Examiner*—Frankie L. Stinson
(74) *Attorney, Agent, or Firm*—Ronald A. Koatz

(57) ABSTRACT

A removable cartridge for a detergent dispensing system for a dishwasher comprising:

a storage unit containing a plurality of cylindrical or spherical detergent tablets arranged in two or more rows with curved surfaces of adjacent tablets touching such that when the cartridge is upright the tablets will move under gravity towards a transfer station, a transfer station comprising ejection means to eject a tablet from the transfer station through a transfer port out of the cartridge, a transfer seal associated with the transfer port to prevent ingress of moisture into the cartridge.

40 Claims, 6 Drawing Sheets

U.S. PATENT DOCUMENTS 4,712,712 A * 12/1987 Garden
4,839,078 A 6/1989 Kruse et al.
5,118,007 A * 6/1992 Lewis et al.
5,167,350 A * 12/1992 Amberg et al.
5,174,471 A * 12/1992 Kozlowski et al.
5,186,912 A * 2/1993 Steindorf et al.
5,593,648 A * 1/1997 Christie et al.
5,604,559 A * 2/1997 Yamanouchi et al.
5,759,501 A * 6/1998 Livingston et al.
5,829,085 A 11/1998 Jerg et al.
6,048,501 A * 4/2000 Lemaire et al.
6,101,851 A * 8/2000 Bolduan et al.
6,409,327 B1 * 6/2002 Koeleman et al.

* cited by examiner

DETERGENT DISPENSER SYSTEM

FIELD OF THE INVENTION

This invention relates to a dishwasher detergent dispenser system and in particular to a system for the controlled delivery of detergent in tablet form to a dishwasher.

BACKGROUND TO THE INVENTION

Various proposals have been made to incorporate a storage unit in to a dishwasher for storing a plurality of detergent tablets to avoid the necessity of the user to recharge the dishwasher with detergent for each washing cycle. Examples of such devices are disclosed in DE 19620088, 19636497 and 129615674.

CA 2189115 discloses a dishwasher comprising a dispensing arrangement for the programmed delivery of cleaning agents in tablet form. The dispensing arrangement includes a storage unit for storing the detergent tablets, a separating device for removing at least one detergent tablet from the storage unit and a lock chamber. The lock chamber separates the detergent tablets stored in the storage unit from the damp ambient conditions of the washing chamber in the dishwasher. The detergent tablets are stored in several stacks in order that minimise space and the separating device can be arranged to remove a predetermined number of detergent tablets from the storage unit.

There are various problems associated with the design of a detergent dispensing system for a dishwasher. The dispensing system should have a storage unit capable of holding sufficient detergent for several wash cycles. The detergent in the storage unit must be completely protected from the damp conditions prevailing in the dishwasher since the detergent will form a solid mass when exposed to moisture. The dispensing device must have an effective means of transferring detergent from the storage unit to the dishwasher. Ideally, the dispensing device should dispense the detergent at the appropriate time at the washing cycle.

Known dispensing devices for detergent tablets have employed detergent tablets having a diameter of at least 24 mm. In some devices the tablets have been arranged in one or more vertical stacks or columns with the circular faces of adjacent tablets in contact with one another. One of the problems associated with this arrangement is that the surface of the tablets is rough because of the granular nature of the detergent and the device for removing a tablet from the stack must be able to overcome the high frictional forces between adjacent tablets. DE 19620088 discloses a dispensing device in which the tablets are stored in a serpentine channel such that adjacent tablets touch circumferentially. However, this arrangement is wasteful of space.

It is an object of the present invention to provide an improved detergent dispensing system from a multitablet storage unit suitable for use in a dishwasher.

BRIEF SUMMARY OF THE INVENTION

According to one aspect of the invention there is provided a removable cartridge for a detergent dispensing system e.g. for a dishwasher, comprising:

- a storage unit containing a plurality of cylindrical or spherical detergent tablets arranged in two or more rows with curved surfaces of adjacent tablets touching such that when the cartridge is upright the tablets will move under gravity towards a transfer station,
- a transfer station comprising ejection means to eject a tablet from the transfer station through a transfer port out of the cartridge and,

- a transfer seal associated with the transfer port to prevent ingress of moisture into the cartridge.

According to a second aspect of the invention there is provided a detergent dispensing system e.g. for a dishwasher, comprising a cartridge as described above and a dispensing chamber having an inlet in communication with the transfer port of the cartridge and an outlet which may be sealed by a door.

The invention provides an effective detergent dispensing system suitable for use in a dishwasher, laundry washing machine etc., which may contain sufficient detergent tablets for many wash cycles e.g. at least ten, preferably at least thirty, which is simple to operate on the part of the user. In preferred embodiments, once the cartridge is in place the user simply selects the desired wash programme and the dishwasher dispense the correct number of tablets at the appropriate time during the wash cycle.

DESCRIPTION OF PREFERRED EMBODIMENTS

The detergent dispensing device of the invention is preferably positioned within the door of the dishwasher thereby does not encroach on any of the volume within the cleaning chamber. Also, it allows the user ready access for the replacement of the cartridge.

An essential component of the detergent dispensing system is a removable cartridge. The cartridge contains the detergent tablets and comprises a mechanism to eject the tablets from the cartridge. The cartridge also has a seal to prevent moisture ingress in to the storage area. The seal is important since ingress of moisture is likely to cause adjacent tablets to agglomerate causing them to jam in the storage unit. Preferably, the entire cartridge is replaced when it is emptied and thus the transfer mechanism and seal will be replaced when a new cartridge is in place. This feature is desirable since it obviates the need to utilise a transfer mechanism and seal which will last the life of the dishwasher and furthermore it reduces the routine maintenance required to keep the dishwasher in perfect running order.

The cartridge utilises spherical or cylindrical detergent tablets. References to detergent tablets herein refer not only to detergent tablets but also to tablets composed of other dishwashing active ingredients e.g. water softeners and rinse aids. The tablets are formed by compaction or pressure moulding of powdered ingredients in a conventional manner.

The spherical tablets preferably have a diameter in the range 10 to 20 mm. The cylindrical tablets used in the cartridge preferably have a diameter in the range 10 to 20 mm and a length which is at least 10% different to the diameter. The reason for the difference in length is to prevent the tablets rotating out of alignment in the rows within the dishwasher. A preferred cylindrical tablets has a diameter of about 17 mm and a length of about 12 mm. The edge between the circular face and cylindrical surface desirable chamfered since this assists in the manufacture of the tablets by compression moulding and also reduces the propensity of the tablets to chip during transportation and storage.

The tablets are arranged in the cartridge in substantially vertical rows when the cartridge is in its upright position. The storage unit comprises a sloping floor or glides to direct tablets towards the transfer station. The transfer station can be at one corner of the cartridge in which case the floor will slope towards that corner. Alternatively, the transfer station may be located spaced from a corner in which case the sloping floor may be in the form of a funnel.

Adjacent rows of tablets are preferably separated by guides which are spaced apart slightly more than the diameter of the cylinder or sphere of the detergent tablets. The use of guides is particularly advantageous since it prevents lateral displacement of the tablets and reduces movement of the tablets when the door of the dishwasher is repeatedly opened and closed. Thus, as well as controlling the orientation of the tablets the guides reduce the propensity of the tablets to impact violently upon each other which could cause breakage of tablets resulting in incorrect dosing or the tablets jamming in the cartridge.

In one embodiment of the invention the storage unit is divided in to two halves by a central wall such that there are two sets of tablets arranged in respective sets of rows. Each set of tablets is associated with its own ejection means.

The tablets may be ejected from the cartridge by any suitable mechanism. For example, the transfer station may simply comprise a door or shutter which is opened for a pre-determined length of time to allow one or more tablets to drop from the storage station out of the cartridge through the transfer port. Alternatively, the transfer station may comprise a plunger or piston which pushes a tablet in the transfer station through the transfer port to eject the tablet from the cartridge. In preferred embodiments of the invention the ejection means comprises a wheel, rotatably about a substantially horizontal axis when the cartridge is in its upright position, the wheel having a plurality of circumferential chambers dimensioned to accommodate a tablet.

In one embodiment the cartridge is arranged such that a tablet in the transfer station moves under gravity in to a chamber in the wheel, rotation of the wheel transports the tablet towards the transfer port where it falls out of the chamber through the transfer port and is ejected from the cartridge.

In a second embodiment the wheel is constructed and arranged such that a tablet in the transfer station moves under gravity in to a chamber in the wheel, rotation of the wheel transports the tablet to the transfer port where it partially falls out of the chamber and further rotation of the wheel causes a cam surface on the wheel to contact the tablet and push the tablet through the transfer port to eject it from the cartridge. This embodiment is particularly useful where it is necessary to apply force the tablet to push it through the transfer seal.

In a further embodiment the wheel is constructed and arranged such that a tablet in the transfer system moves under gravity in to a chamber in the wheel, rotation of the wheel transports the tablet towards the transfer port and further rotation of the wheel causes the chamber to partially collapse thereby expelling the tablet from the chamber through the transport port and ejecting it from the cartridge. In this embodiment the chambers in the wheel are flexible and they are deformed as the wheel rotates e.g. by contacting a projection or pin formed in the wall of the transfer station. The walls are deformed in such a manner that the tablet is pushed radially outward from the chamber.

When there are two sets of tablets arranged in the cartridge the ejection means may conveniently comprise two wheels rotatable about a common axis. The wheels may be independently rotatable thereby allowing a different type of table to be used in each set which may be ejected from the cartridge and dispensed independently. Alternatively, the two wheels may be fixed related to each other with chambers off-set such that rotation of the wheel causes alternate ejection of a tablet from each set of tablets.

Generally, the transfer seal covers the transfer port. In one embodiment the seal may act as a door of shutter movable between a closed position which seals the transfer port and an open position which allows ejection of a tablet through the transfer port. Such a seal may be sliding rotatable or hinged. Preferably, the transfer seal is in the form of an elastomeric film covering the transfer port and having one or more slits which allow a tablet to be pushed through the seal. Suitable elastomeric materials include rubber, plastics etc. e.g. silicone.

Alternatively, or in addition, the circumferential edge of the wheel may form a seal with the housing of the cartridge or edge of the transfer port.

The cartridge may have a manual actuation mechanism e.g. a handle to allow the user to eject the appropriate number of tablets from the cartridge before the washing cycle is started. Preferably, the dispensing system comprises control means and drive means to actuate the ejection means of the cartridge. In such an embodiment, the ejection means comprises means to engage the drive means on the dishwasher e.g. cog wheel etc.

Since replacement cartridges loaded with detergent tablets will be stored ready to replace an exhausted cartridge, it is desirable that the cartridge is sealed in a manner to prevent ready access to the detergent tablets therein e.g. to prevent children extracting the detergent tablets. In embodiments where the cartridges are not intended to be refilled the only point of access to the tablets will be via the transfer port. The transfer port may be sealed with a tamper proof seal which is broken off prior to insertion of the cartridge. Alternatively, or in addition, the wheel of the ejection means may be immobilised prior to insertion of the cartridge. The housing of the cartridge may conveniently be manufactured of transparent plastics so that the contents may be viewed.

The cartridge is in communication with the inlet of a dispensing chamber. The dispensing chamber has an outlet which may be sealed by a shutter or door. One or more tablets ejected from the cartridge passes to the dispensing chamber. The tablets are held in the dispensing chamber until the door is opened at the appropriate time during the washing cycle to introduce the tablet(s) in to the washing chamber of the dishwasher. In order to minimise the possibility of moisture ingress in to the dispensing chamber and thence to the cartridge, the door of the dispensing chamber is preferably biased to its closed position sealing the outlet of the dispensing chamber. The door is opened only for a sufficient time to allow the tablet(s) to exit the dispensing chamber and then the outlet of the dispensing chamber is immediately sealed. The possibility of moisture ingress can be further reduced by dispensing the tablets into the washing chamber while the water therein is quiescent i.e. not during spraying or agitation in the washing cycle, and ensuring the outlet is sealed when water is sprayed and also during the drying cycle to prevent ingress of water vapour.

The outlet of the dispensing chamber is conveniently sealed by a door. The door may conveniently be pivoted about a horizontal axis at its upper or lower edges. In accordance with a one embodiment the door is substantially vertical when sealing the outlet of the dispensing chamber and is pivoted about a horizontal axis at the bottom of the door. The door comprises a substantially horizontal extension which forms the base of the dispensing chamber when the door is in its closed position. Thus, tablets entering the dispensing chamber from the cartridge will lodge on the horizontal extension of the door. As the door pivots downwardly to its open position the extended portion forming the base of the chamber is caused to pivot upwardly thereby expelling the tablets from the dispensing chamber.

The transfer port of the cartridge may communicate directly with the inlet of the dispensing chamber. For example, the cartridge may be positioned directly above the dispensing chamber so that tablets ejected through the transfer port of the cartridge drop into the dispensing chamber. Alternatively, the cartridge may be displaced relative to the dispensing chamber and an intermediate passage and/or holding chamber may be between the transfer port of the cartridge and the inlet of the dispensing chamber. In such an arrangement, if the tablets are not able to fall in to the dispensing chamber under the influence of gravity, conveyor means may be provided to move the tablets through the intermediate passage and/or holding chamber into the dispensing chamber. Any suitable conveyor means may be used e.g. a plunger or piston to push tablets from the intermediate passage or holding chamber in to the dispensing chamber.

The cartridge may conveniently comprise one or more recognition features which are detectable by a detection system in the dishwasher to identify the contents of the cartridge. The recognition features may be physical e.g. projections, lugs etc. which are engageable with a detection system in the dishwasher. Alternatively, the cartridge may have a code pattern applied to its surface e.g. a bar code or DX-type code, which may be detected by a detection system in the dishwasher to identify the contents of the cartridge. In a further embodiment, the cartridge may comprise a micro chip containing information about the contents of the cartridge which may be read by a detection system in the dishwasher.

The dishwasher preferably comprises control means to control the ejection of tablets from the cartridge and/or release of tablets from the dispensing chamber. The control means may receive information from any detection system in the dishwasher and act upon the information received. The control means may conveniently release tablets from the dispensing chamber at pre-determined time during wash cycle and also ensure that the door of the dispensing chamber closes immediately after releasing the tablets. The control means may also operate to eject the requisite number of tablets from the cartridge in response to a particular wash programme selected on the dishwasher. For example, a plurality of tablets may be ejected for a heavy wash programme and a single tablet for a light wash programme. The control means may also allow multiple dispensing of tablets during a single wash cycle. Thus, a tablet may be dispensed during the prewash and a further one or more tablets may be dispensed during the main wash. If there are different types of tablets in the storage unit a different tablet may be dispensed for the rinse cycle etc.

The dishwasher preferably comprises means to detect and signal when the cartridge is substantially empty in order that the user may obtain a fresh cartridge before the existing cartridge has expired. In one embodiment, the dishwasher may automatically order a new cartridge from the supplier e.g. via the internet, when the cartridge is almost empty.

The invention will now be described with reference to the accompanying drawings in which.

Figure 4:
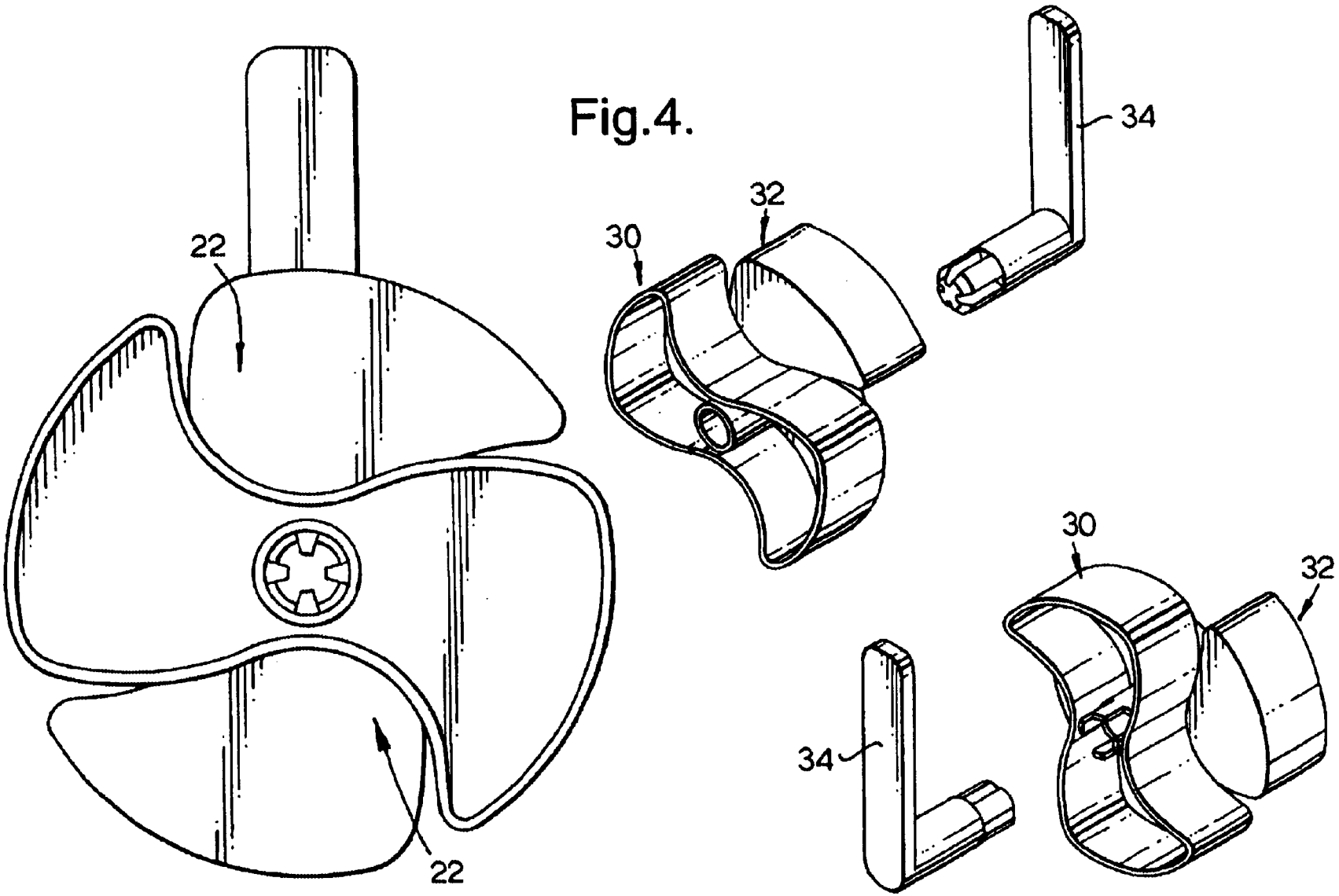
Figure 5B:
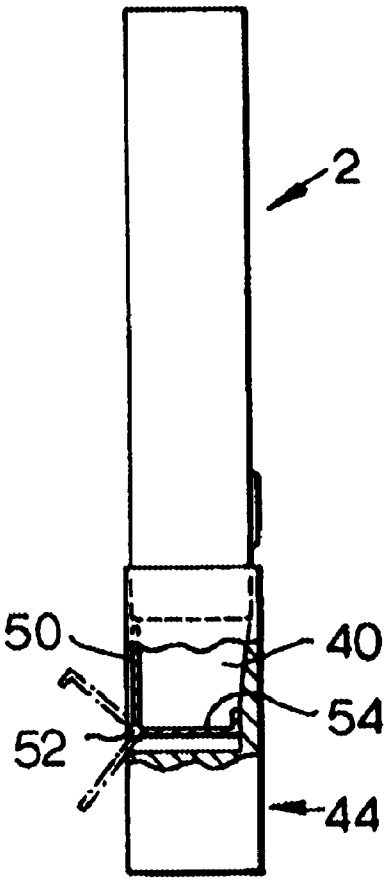
Figure 5A:
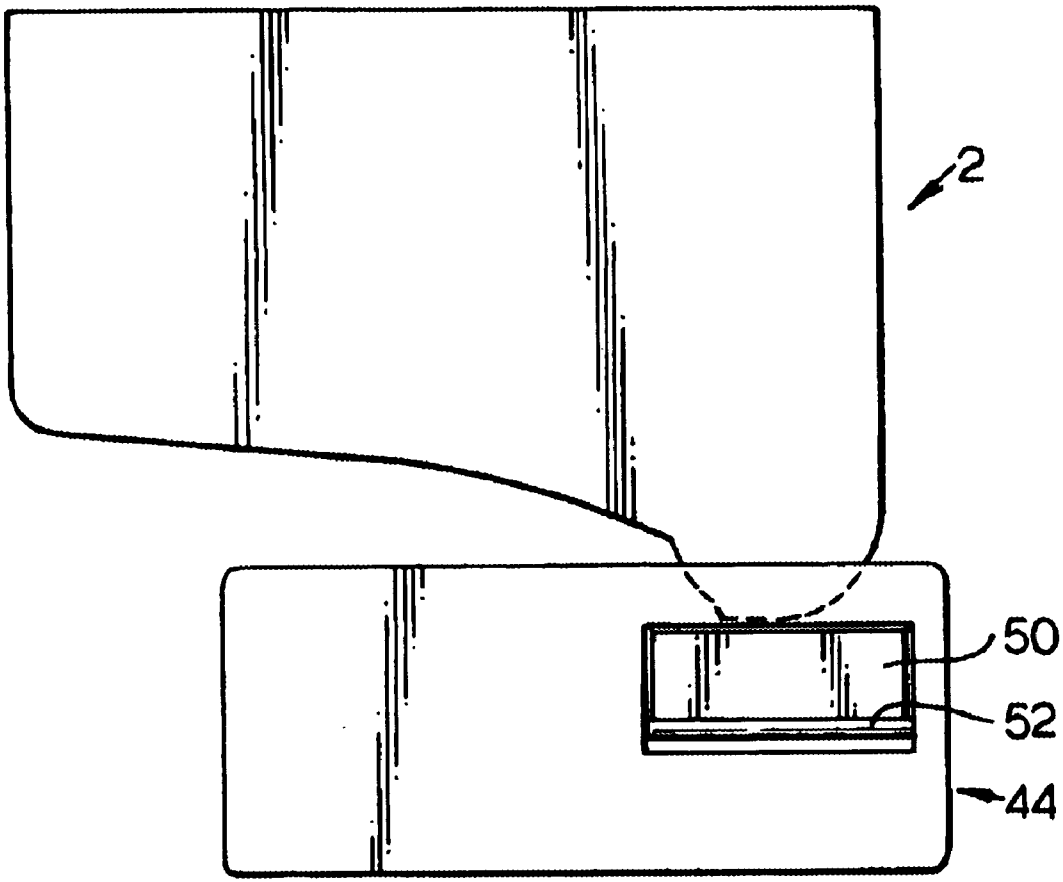

FIGS. 3*a*, 3*b*, 3*c* and 3*d* represent a cross-section, partial cross-sectional plan, perspective view and partial perspective view respectively of a further cartridge in accordance with the invention;

FIG. 4 represents an exploded view of the ejection means of the cartridge shown in FIG. 3 and FIGS. 5*a* and 5*b* represent diagrams of a front and sectional side view of a further dispensing system in accordance with the invention .

In the drawings, like numerals represent like parts.

Figure 1:
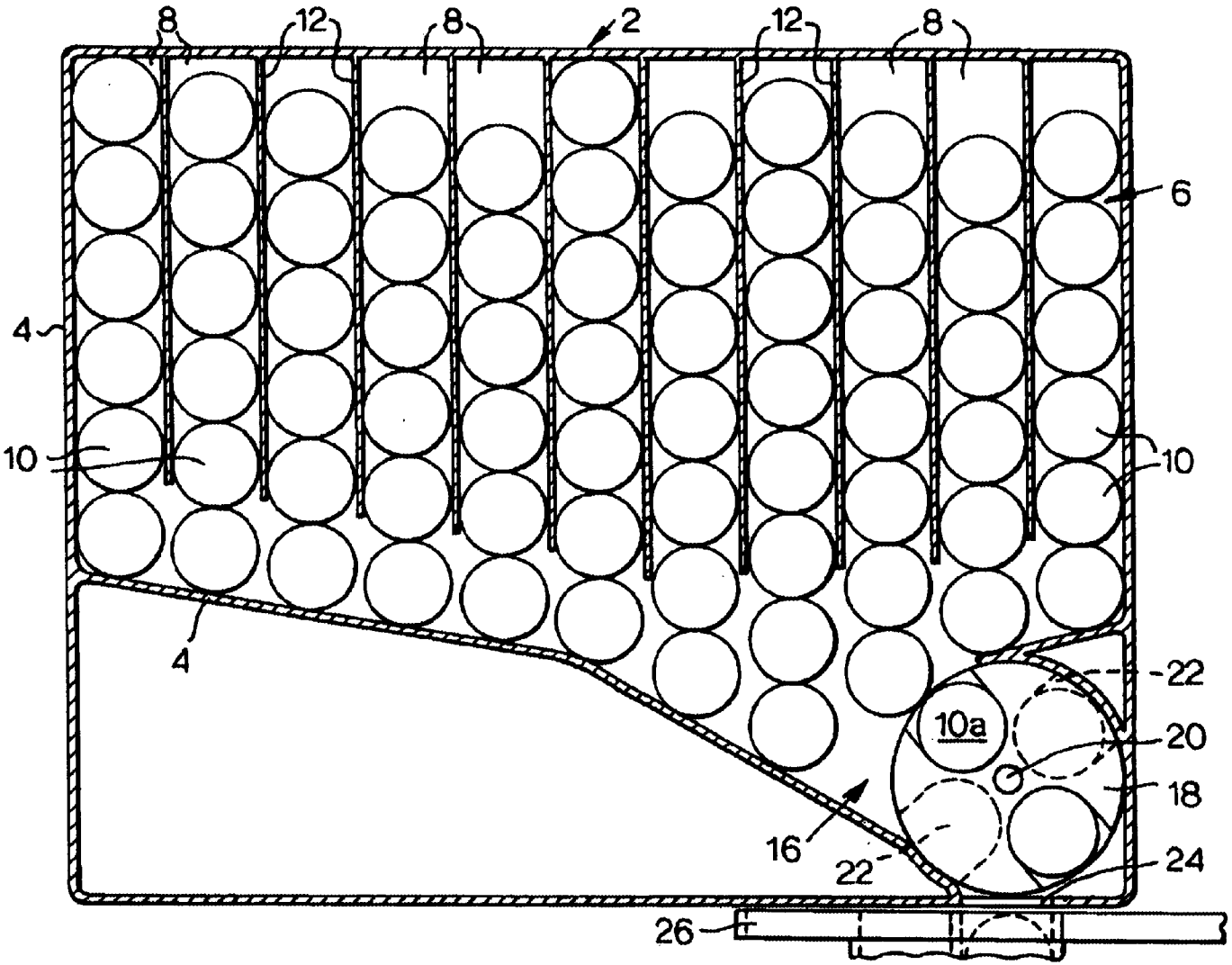
FIG. 1 represents a cross-section through a cartridge in accordance with the invention.

FIG. 1 illustrates a cartridge 2 comprises a housing 4 defining a storage unit 6 having a plurality of rows 8 of detergent tablets 10. The detergent tablets 10 are cylindrical in shape and are arranges such that adjacent tablets in a row touch circumferentially. The rows are separated by guides 12 which restrict movement of the detergent tablets.

The cartridge has a sloping floor 14 such that tablets in the storage unit 6 drop under gravity towards the transport station 16. The guides are dimensioned so that the lower most tablet in each row may roll over the floor 14 towards the transport station 16.

The ejection means comprises a wheel 18 mounted for rotation about axis 20. The wheel comprises four circumferential chambers 22 which are dimensioned to accommodate a tablet. In use, a tablet (shown as 10*a*) enters a circumferential chamber 22 and the wheel is rotated clockwise to transport the tablet 10*a* to the transfer port 24 as the tablet reaches the facility of the transfer port 24, sliding seal 26 is displaced allowing the tablet to drop out of the chamber 22 through the transfer port 24 thereby being ejected from the cartridge.

Figure 2:
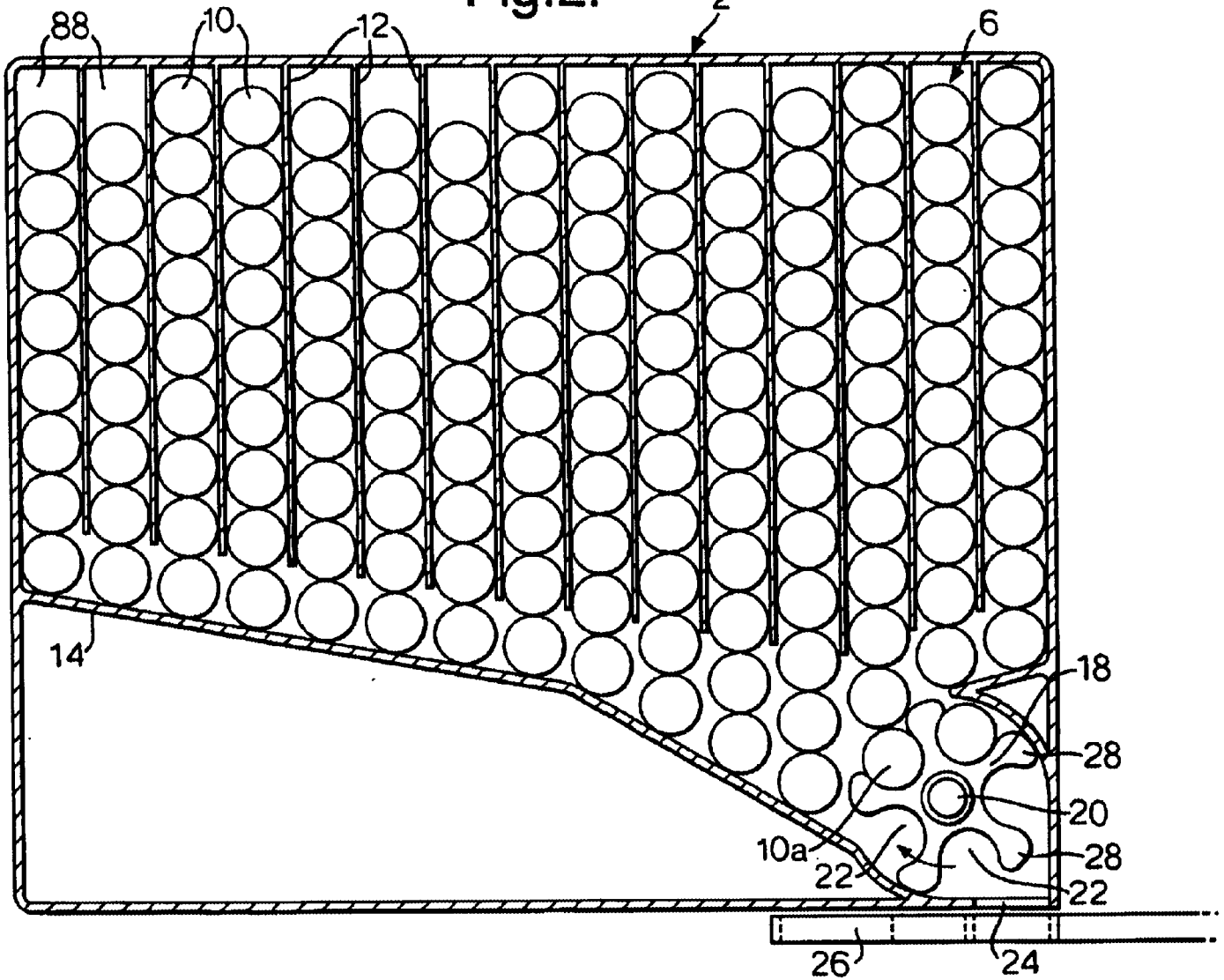
FIG. 2 represents a cross-section through an alternative cartridge in accordance with the invention.
Figure 3A:
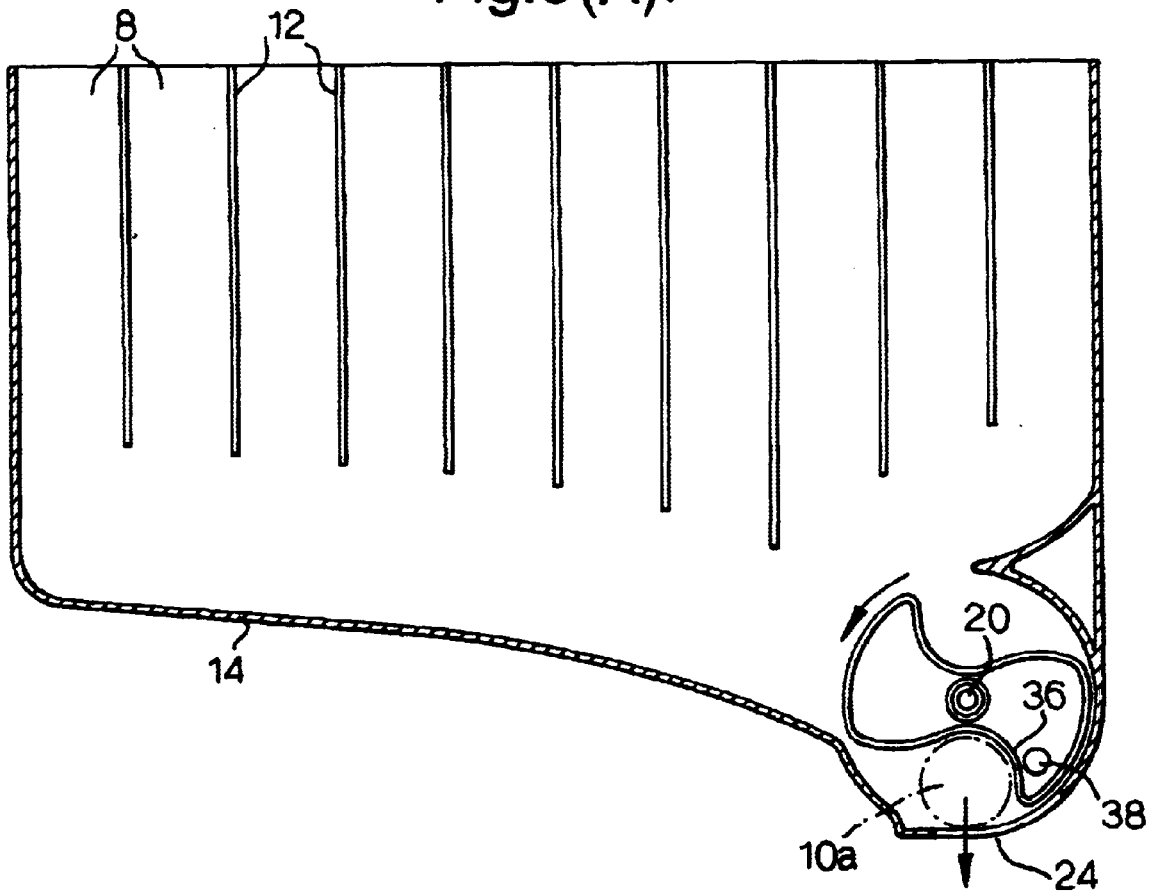
Figure 3B:
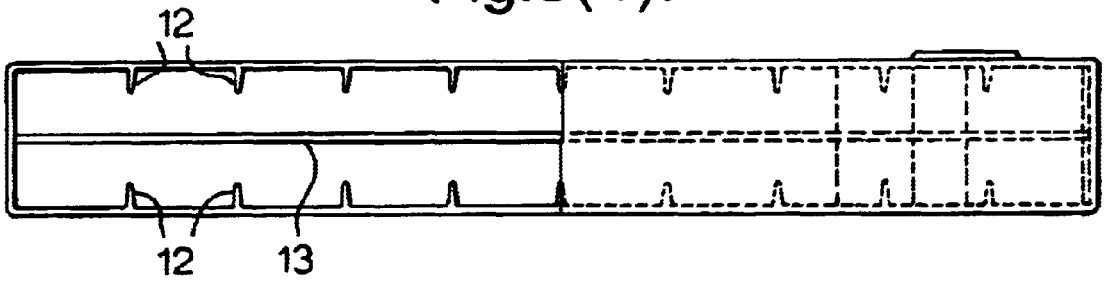
Figure 3C:
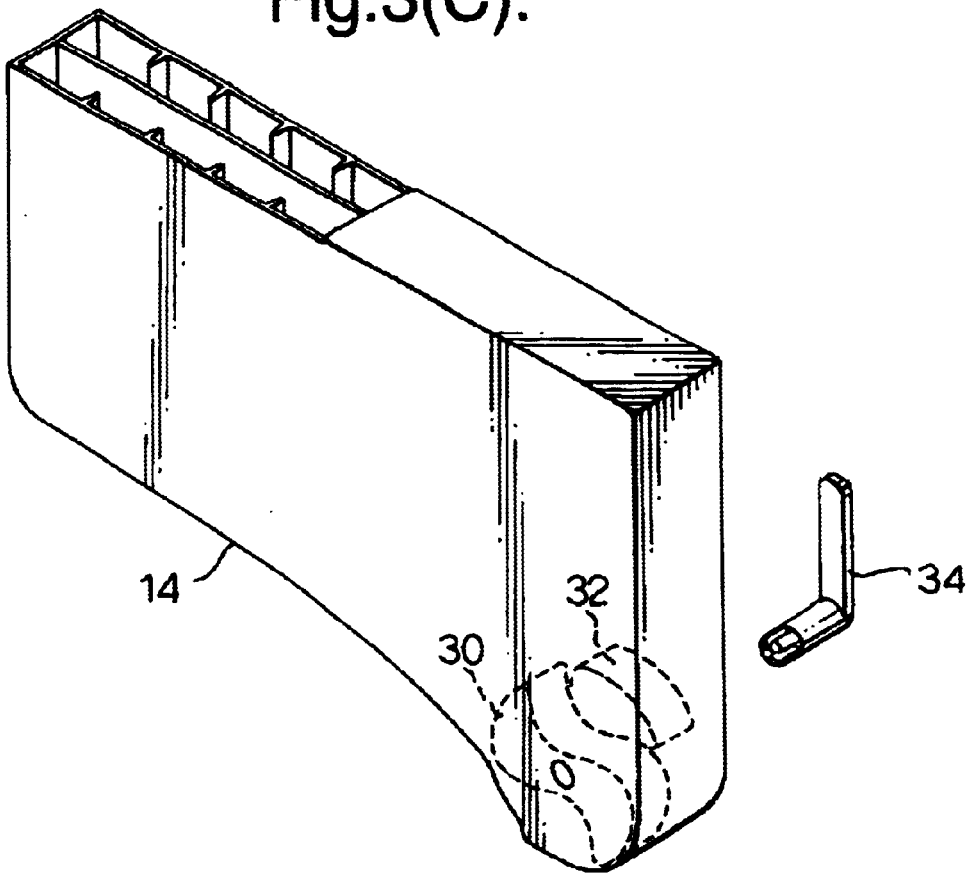
Figure 3D:
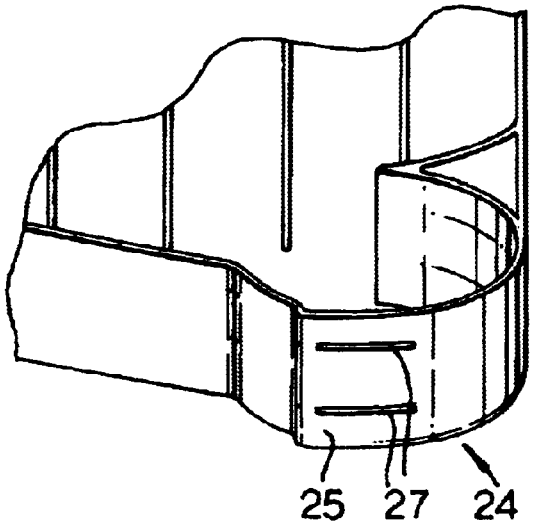

FIG. 2 shows a cartridge of similar construction to FIG. 1 with the exception that the wheel 18 comprises cam surfaces 28. A detergent tablet 10*a* is held in the circumferential chamber 22 and transported from the storage unit to the transfer port 24. The seal 26 may be a sliding seal or a fixed seal comprising a flexible elastomer having a slit therein. Instead of dropping completely through the transfer port the tablet 10*a* is partially displaced from the chamber 22 and as the wheel is further rotated the following cam surface 28 pushes against the tablet urging it through the transfer port 24 and ejecting it from the cartridge.

FIGS. 3 and 4 illustrate an alternative cartridge in accordance with the invention. In this embodiment the cartridge comprises two sets of detergent tablets (not shown) separated by an internal wall 13.

The ejecting means comprises two wheels 30, 32 (FIG. 4) each having two chambers 22. The wheels 30, 32 may be independently rotatable about axis 20 or they may be fixed relative to each other with the chambers off-set as shown in FIG. 4. The walls of the chambers 22 are constructed of deformable plastics material. A handle 34 is shown for manual rotation of the wheel although it is preferred that the device is rotated by drive means mounted in the dishwasher.

The transfer port 24 is covered by a transfer seal which is a fixed film of elastomer 25 having a slits 27 therein, one slit for each set of tablets. As the wheel is rotated in the direction of the arrow shown in FIG. 3*a* a detergent tablet 10*a* is transported from the storage unit towards the transfer port 24. As the tablet 10*a* approaches the patient port the wall 36 of the circumferential chamber engages a pin 38 projecting from the housing of the cartridge causing the wall to deform as the rotation of the wheel continues and push the tablet through the transfer port and slit 27 in the transfer seal 25. The pin 38 projects to an extent that it just engages the edge of the wall 36. On further rotation of the wheel the wall 36 deforms until it is able to slide under the pin 38 and free rotation continues until the next portion of the wall 36 engages the pin.

FIGS. 5*a* and 5*b* diagrammatically illustrate the arrangement of a cartridge and dispensing chamber in accordance with the invention. The cartridge is as illustrated in FIGS. 3 and 4.

The dispensing chamber 40 comprises a housing 44. The outlet of the dispensing chamber is closed by a door 50 which is pivoted about a horizontal axis 52 at the base of the door. The door additionally comprises an extended portion 54 which forms the base of the dispensing chamber 40 when the door is in its closed position. Thus, tablets from the cartridge 2 will fall on to the extended portion 54 when they are transferred from the cartridge. When the door 50 is opened by pivoting about axis 52 to the position shown in phantom outline, the extended portion 54 will pivot together with the door thereby transporting any tablets in the dispensing chamber through the outlet in to the washing chamber of the dishwasher.

What is claimed is:

1. A removable cartridge for a detergent dispensing system for a dishwasher, comprising:

a storage unit containing a plurality of cylindrical or spherical detergent tablets arranged in two or more rows with curved surfaces of adjacent tablets touching such that when said cartridge is upright said tablets will move under gravity towards a transfer station, a transfer station comprising ejection means to eject a tablet from said transfer station through a transfer port out of the cartridge and a transfer seal associated with said transfer port to prevent ingress of moisture into the cartridge.

2. A removable cartridge according to claim 1 wherein said cartridge is in its upright position said tablets are arranged in substantially vertical rows and said storage unit comprises a sloping floor to direct tablets towards said transfer station.

3. A removable cartridge according to claim 2 wherein adjacent rows of said tablets are separated by guides to prevent lateral displacement of tablets from a row.

4. A removable cartridge according to claim 1 wherein said tablets are substantially cylindrical having a diameter in the range 10 to 20 mm and a length which is at least 10% different from the diameter.

5. A removable cartridge according to claim 4 wherein said tablets have a length greater than the diameter.

6. A removable cartridge according to claim 1 which comprises two sets of said tablets each set being arranged in rows and each set of tablets having its own ejection means.

7. A removable cartridge according to claim 1 wherein said ejection means comprises a wheel rotatable about a substantially horizontal axis when said cartridge is in its upright position, said wheel having means to define a plurality of circumferential chambers dimensioned to accommodate a tablet.

8. A removable cartridge according to claim 7 wherein said wheel is constructed and arranged such that a tablet in the transfer station moves under gravity into a chamber in said wheel and rotation of said wheel transports said tablet in said chamber to the transfer port where it falls out of said chamber through said transfer port.

9. A removable cartridge according to claim 7 wherein said wheel is constructed and arranged such that a tablet in said transfer station moves under gravity into a chamber in said wheel, rotation of said wheel transports said tablet in said chamber to said transfer port where it partially falls out of said chamber and further rotation of the wheel causes a cam surface on the wheel to contact said tablet and push said tablet through said transfer port.

10. A removable cartridge according to claim 7 wherein said wheel is constructed and arranged such that a tablet in the transfer station moves under gravity in to a chamber in said wheel, rotation of said wheel transports said tablet in said chamber towards the transfer port and further rotation of said wheel causes said chamber to partially collapse expelling said tablet from said chamber through said transfer port.

11. A removable cartridge according to claim 7 comprising two sets of said tablets, each set being arranged in rows and said ejection means comprises two wheels rotatable about a common axis.

12. A removable cartridge according to claim 11 wherein said two wheels are fixed relative to each other with chambers off-set such that rotation of the wheels causes alternate transport of tablet from each set of tablets.

13. A removable cartridge according to claim 1 wherein said transfer port is covered by a transfer seal which is moved aside when a tablet is ejected from said cartridge.

14. A removable cartridge according to claim 1 wherein said transfer port is covered by a transfer seal in the form of an elastomeric film having one or more slits therein and the tablet is pushed through the elastomeric as it is ejected from the cartridge.

15. A cartridge according to claim 1 additionally comprising means to manually operate said ejection means.

16. A removable cartridge according to claim 1 wherein said ejection means comprises means to engage with drive means mounted on a dishwasher.

17. A removable cartridge according to claim 1 wherein said cartridge is sealed to prevent ready access to detergent tablets therein.

18. A removable cartridge according to claim 1 wherein said cartridge comprises a housing comprising transparent material so that said tablets therein are visible.

19. A removable cartridge according to claim 1 which additionally comprises one or more physical recognition features engageable with a detection system to identify the contents of the cartridge.

20. A removable cartridge according to claim 1 which additionally comprises a code pattern applied to its surface which may be detected by a detection system to identify the contents of the cartridge.

21. A removable cartridge according to claim 1 which additionally comprises a microchip containing information of the contents of the cartridge.

22. A detergent dispensing system for a dishwasher comprising a removable cartridge comprising:

a storage unit containing a plurality of cylindrical or spherical detergent tablets arranged in two or more rows with curved surfaces of adjacent tablets touching such that when said cartridge is upright said tablets will move under gravity towards a transfer station, a transfer station comprising ejection means to eject a tablet from said transfer station through a transfer port out of the cartridge a transfer seal associated with said transfer port to prevent ingress of moisture into the cartridge and a dispensing device having an inlet in communication with said transfer port of said cartridge and an outlet for dispensing tablets and a door which in a closed position seals.

23. A detergent dispensing system according to claim 22 wherein said dispensing device comprises means to maintain said door in its closed position sealing the outlet except when dispensing tablets.

24. A detergent dispensing system according to claim 23 wherein said door of said dispensing chamber is spring biased to its closed position sealing said outlet.

25. A detergent dispensing system according to claim 22 wherein said transfer port of the cartridge communicates directly with said dispensing chamber of said dispensing device.

26. A detergent dispensing system according to claim 25 wherein said cartridge is positioned directly above said dispensing chamber.

27. A detergent dispensing system according to claim 22 which additionally comprises an intermediate passage and/or a holding chamber between said transfer port of said cartridge and said dispensing device.

28. A detergent dispensing system according to claim 27 which additionally comprises conveyor means to move tablets in said intermediate passage or holding chamber into said dispensing chamber.

29. A detergent dispensing system according to claim 28 wherein said conveyor means comprises a plunger to push tablets from said intermediate passage or holding chamber into said dispensing chamber.

30. A detergent dispensing system according to claim 22 additionally comprising control means to control ejection of tablets from said cartridge and/or release of tablet(s) from said dispensing chamber.

31. A detergent dispensing system according to claim 30 wherein said control means releases tablet(s) from said dispensing chamber at a predetermined time in the wash cycle.

32. A detergent dispensing system according to claim 30 wherein said control means closes the door of the dispensing chamber immediately after releasing tablet(s).

33. A detergent dispensing system according to claim 30 wherein said control means releases tablets from said dispensing chamber after water has entered the dishwasher but before water is circulated.

34. A detergent dispensing system according to claim 30 wherein said control means operates to eject a requisite number of tablets from said cartridge in accordance with the wash programme selected on the dishwasher.

35. A detergent dispensing system according to claim 34 wherein said control means dispenser tablets based on information detected about the contents of the cartridge.

36. A detergent dispensing system according to claim 30 wherein said control means causes dispensing of tablets at different stages in a wash cycle.

37. A detergent dispensing system according to claim 22 wherein said door of said dispensing device is pivoted about a horizontal axis at its upper or lower edge.

38. A dishwasher comprising a detergent dispensing system comprising:

a storage unit containing a plurality of cylindrical or spherical detergent tablets arranged in two or more rows with curved surfaces of adjacent tablets touching such that when said cartridge is upright said tablets will move under gravity towards a transfer station, a transfer station comprising ejection means to eject a tablet from said transfer station through a transfer port out of the cartridge a transfer seal associated with said transfer port to prevent ingress of moisture into the cartridge and a dispensing device having an inlet in communication with said transfer port of said cartridge and an outlet for dispensing tablets and a door which in a closed position seals.

39. A dishwasher according to claim 38 additionally comprising a door wherein such detergent dispensing system is mounted in said door.

40. A dishwasher according to claim 38 which additionally comprises means to signal when the cartridge is substantially empty.

* * * * *